United States Patent [19]

Breckwoldt

[11] Patent Number: 4,719,929

[45] Date of Patent: Jan. 19, 1988

[54] NON-TOBACCO SMOKING MATERIALS

[75] Inventor: Robert G. Breckwoldt, Goshen, N.Y.

[73] Assignee: Tripar Incorporated, Stamford, Conn.

[21] Appl. No.: 914,830

[22] Filed: Oct. 2, 1986

[51] Int. Cl.[4] ..... A24B 15/10; A24B 15/28; A24D 1/18

[52] U.S. Cl. ..... 131/359; 131/352; 131/369

[58] Field of Search ..... 131/352, 359, 369

[56] References Cited

PUBLICATIONS

"Gasohol, A Step to Energy Independence", Alltech Technical Publications, Lexington, Kentucky, U.S.A., 1981, pp. 209–221.

*Primary Examiner*—V. Millin

*Attorney, Agent, or Firm*—Kane, Dalsimer, Sullivan, Kurucz, Levy, Eisele and Richard

[57] ABSTRACT

A smoking material comprises cellulose homogeneously mixed with a smoke-affecting proportion of distiller's dried grain with solubles. The smoking material of the invention possesses a smooth, flavor-enhanced, nicotine-free smoke. The material of the invention is also a useful tobacco casing.

8 Claims, 1 Drawing Figure

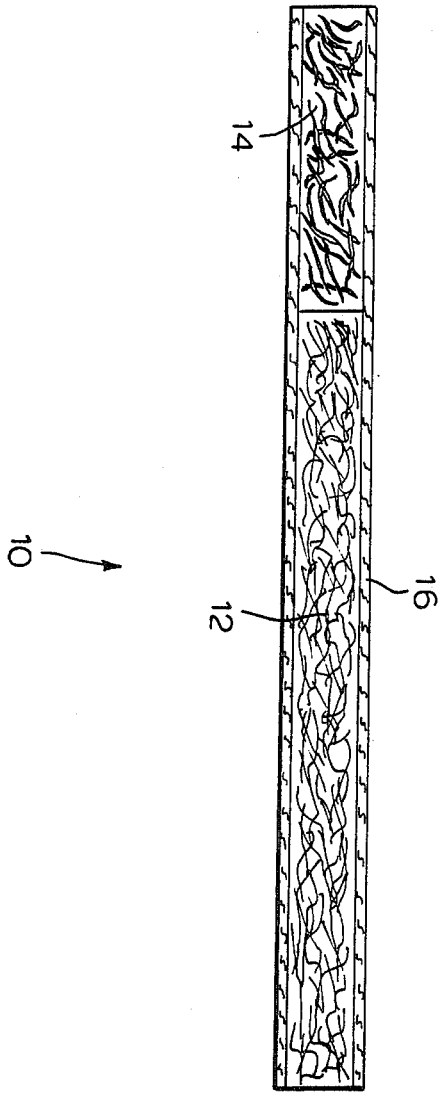
16
12
10
14

NON-TOBACCO SMOKING MATERIALS

BACKGROUND OF THE INVENTION

1. Field of the Invention

The invention relates to smoking materials and more particularly relates to a non-tobacco smoking product.

2. Brief Description of the Prior Art

In U.S. Pat. No. 2,930,719 there is disclosed a wide variety of nicotine-free products which are suggested for use in a tobacco-free smoking product including ingredients containing niacin and rutin.

U.S. Pat. Nos. 3,369,352 and 3,369,551 disclose a process for preparing a smoking product and a smoking product which is a water and organic solvent extracted porous residuum of the leafy portion of a plant selected from the group consisting of lettuce, cabbage, broccoli, collard, kohlrabi, spinach and papaya plus added sweetners, vitamins and other ingredients.

U S. Pat. No. 3,034,931 discloses a substitute tobacco product made from sagebrush. In order to obtain a desirable flavor it is suggested that one should add paprika and tumeric.

U.S. Pat. No. 3,702,615 discloses a non-tobacco smoking, chewing and dipping product of leaves of lettuce, spinach or cabbage.

U.S. Pat. No. 3,703,177 discloses a smoking product that is made from waste beet pulp which may be used alone or may be blended with tobacco.

Other patents disclosing tobacco substitutes or methods of modifying tobacco are U.S. Pat. Nos. 3,106,209; 3,575,177; 3,638,660; 3,705,589; 3,491,766; 2,943,958; 2,943,959; 2,907,686; 3,738,374; 3,100,492; 3,255,760; 3,545,448; 3,434,171 3,323,524; and 3,720,660.

In spite of the wide variety of non-tobacco materials which have been suggested as smoking materials, none have gained widespread smoker acceptance. There remains a need for non-tobacco smoking products.

In addition, tobacco is grown in many parts of the world, and thus the quality of the actual cured leaf varies very considerably, in color, texture and, of course, its smoking qualities. Also, the way in which the tobacco is "cured" gives rise to another set of variations. The art of the tobacco blender is to achieve the desired quality of smoke, within given parameters, e.g. flavor, tar content, economics, from the range of tobaccos at his disposal.

Flavors can be varied by adding sweet materials, e.g. molasses, fruit juices, honey or even alcoholic liquors—rum, whisky, etc. to tobacco (the so-called casing agents). Light, "top-note" flavors can be added by spraying on flavors.

And so, there is also a demand for tobacco additives which will modify tobacco smoke to give an acceptable, flavorful smoke.

The compositions of the present invention fulfill the above-described needs by making available a smokable, non-tobacco material. This material is also useful to case tobacco, improving a harsh tasting tobacco smoke.

SUMMARY OF THE INVENTION

The invention comprises a composition of matter, which comprises; a homogeneous blend of a smokably acceptable, cellulose carrier and a smoke flavor enhancing proportion of distiller's dried grain and solubles; said composition being free of a compound selected from the group consisting of tobacco or tobacco extracts. The invention also comprises smoking articles made from the compositions of the invention.

The compositions of the invention are useful as the smoking material in a smoking article and as a tobacco casing material. The compositions of the invention are advantageous as smoking materials in that they are substantially free of nicotine.

BRIEF DESCRIPTION OF THE DRAWING

The drawing is a cross-sectional, side elevation of an embodiment smoking article of the invention.

DETAILED DESCRIPTION OF THE PREFERRED EMBODIMENTS OF THE INVENTION

Distiller's dried grain with solubles (referred to hereinafter at times as "DDGS") is the product obtained upon drying stillage (sometimes called "slop"), which is the residue after distillation and removal of alcohols from beer or fermentated grain mash. Typically the DDGS is prepared by first separating fiber or suspended solids from the stillage. The residue of soluble solids is then concentrated to the consistency of a paste (called syrup) and then remixed with the separated fiber. The remixed fiber and syrup is then dried to obtain a meal which is the DDGS employed in the present invention.

The DDGS is readily available from commercial sources. The composition of DDGS is well known. A typical DDGS composition will comprise crude protein (27 percent by weight), crude fat (8 percent by weight) and crude fiber (8.5 percent by weight); dry matter constituting about 92.5 percent by weight.

The smoking material of the invention is prepared by homogeneously mixing the DDGS with a smokable form of cellulose, free of tobacco or tobacco extracts. Representative of smokable forms of cellulose are vegetable cellulose pulps such as pulps of softwood trees, hydroxymethyl cellulose, hydroxy- ethyl cellulose, carboxymethyl cellulose, methyl cellulose, ethyl cellulose, hydroxypropyl cellulose, carboxymethyl hydroxyethyl cellulose and the like.

A homogeneous blend of the cellulose carrier and the DDGS may be obtained by bringing the two components together and mixing them together employing conventional equipment and mixing techniques. For example, blending may be carried out in a conventional tobacco blending chest.

Advantageously, the blend of cellulose and DDGS is wet processed into a dry sheet or web (analogous to a sheet of paper). The method of processing such a blend into a dry sheet is well known and may be that described in the U.S Pat. Nos. 3,297,039 and 4,542,755 (both of which are incorporated herein by reference thereto).

The proportion of DDGS homogeneously blended with or added to the smokable cellulose to obtain the smoking material of the invention is a smoke-enhancing proportion. In general a smoke-enhancing proportion will be an amount within the range of from about 0.5 to 80 percent by weight of the cellulose carrier; preferably about 3 to 50 percent; most preferably 5 to 30 percent.

In addition to DDGS and cellulose the smoking materials of the invention may contain conventionally employed proportions of conventionally known tobacco additives such as flavorants (like menthol), binders, humectants (like propylene glycol, sorbitol and the like), extenders or fillers, flavor enhancers and the like.

Representative of specific additives which may be employed are:

Acetophenone
Alfalfa Extract
Chamomille Flower Extract
Vanillin
Heliotropine
2,3,5,6-Tetramethyl pyrazine
2,3,5-Trimethyl pyrazine
Licorice Extract
Cocoa Extract
Molasses
Clary Sage Oil
St. Johns Bread Extrsact
Valerian Root Extract
Oakmoss Absolute mixtures thereof and the like.

The compositions may be used to case harsh smoking tobacco of any type and source, thereby modifying the smoke to obtain a mellower, more desirable smoke. When used as a casing, the compositions of the invention may be used in a proportion of from 2 to 25 parts by weight of the tobacco.

Used alone or in admixture with tobacco as a casing, the compositions of the invention may be incorporated into conventional smoking articles such as cigarettes by wrapping in conventional papers and, optionally with added filter elements. The methods of manufacture are well known; see for example U.S. Pat. No. 4,553,555. The accompanying drawing is a cross-sectional, side elevation of an embodiment smoking article 10 of the invention made up of a smoking material rod 12, a of the invention made up of a smoking material rod 12, a filter component 14 and a paper wrapper 16. The article 10 may be smoked in a conventional way.

The following examples describe the manner and the process of making and using the invention and set forth the best mode contemplated by the inventor for carrying out the invention.

EXAMPLE 1

Handsheets of smokable material are prepared by first blending together a mixture of bleached southern pine softwood pulp (19.5% by weight) and 4.5 percent by weight of glycerin and 76% by weight of DDGS (flaked, average particle size less than 60 mesh). The blend, having a moisture content of circa 35 percent, is processed into handsheets by the general method described in Example 1 of U.S. Pat. No. 4,542,755. The handsheets are then shredded to obtain a cigarette smoking material of the invention. An analysis of the handsheets shows as a typical analysis:

Fiber: 28.5%
Extractables & Reducing Sugars: 28.0%
Protein: 21.5%
Fat: 9.0%
Water: 5.4%
Glycerin: 4.6%
Ash: 3.0%
Nicotine Content: Less than 0.01 mg/g

EXAMPLE 2

The shredded handsheet of Example 1, supra, is mixed with shredded Burley tobacco at a level of 10% of the weight of the tobacco as casing.

EXAMPLE 3

The smoking materials of Examples 1 and 2, supra, are separately incorporated into smoking articles (cigarettes) and smoked by a panel of smokers. The cigarettes are made up using medium porosity paper and monoacetate high pressure drop filters. The smoke obtained from the smoking material of Example 1 was found to be acceptable as a smoking article. The smoke obtained from the material of Example 2 was found to be smoother, less harsh than smoke from the original tobacco cased with the material of Example 1. The casing of the tobacco mellows the tobacco and lends a "sweet-woody" note.

What is claimed is:

1. A composition of matter, which comprises; a homogeneous blend of a smokably acceptable, cellulose carrier and a smoke flavor enhancing proportion of distiller's dried grain and solubles; said composition being free of a compound selected from the group consisting of tobacco or tobacco extracts.

2. A composition of claim 1 wherein the proportion of distiller's dried grain with solubles is within the range of from about 0.5 to about 80 percent by weight of cellulose.

3. The composition of claim 1 in the form of a sheet.

4. The composition of claim 3, shredded.

5. A smoking article, which comprises;

(a) a rod of smoking material which comprises;
  a homogeneous blend of a smokably acceptable, cellulose carrier and a smoke flavor enhancing proportion of distiller's dried grain and solubles;
  said blend being free of a compound selected from the group consisting of tobacco and tobacco extracts; and (b) paper wrapper means enclosing the rod; said enclosed rod being open at the ends thereof.

6. The smoking article of claim 5 wherein the blend includes a tobacco.

7. The smoking article of claim 5 wherein one end of the rod is closed with a filter element.

8. A method of casing tobacco, which comprises;

providing tobacco, characterized in part by a harsh smoke; and blending with the provided tobacco a smoke improving proportion of a composition, which comprises;
  a homogeneous blend of a smokably acceptable, cellulose carrier and a smoke flavor enhancing proportion of distiller's dried grain and solubles; said homogeneous blend being free of a compound selected from the group consisting of tobacco or tobacco extracts.

* * * * *